United States Patent [19]

Jensen

[11] 4,366,659

[45] Jan. 4, 1983

[54] CONSTRUCTION MEMBER AND CONNECTING PLATE STRUCTURE

[75] Inventor: Keith A. Jensen, Sandy, Utah

[73] Assignees: A. Park Smoot, Murray; Reese J. Goodwin, Provo, both of Utah ; a part interest

[21] Appl. No.: 166,764

[22] Filed: Jul. 8, 1980

Related U.S. Application Data

[63] Continuation-in-part of Ser. No. 906,067, May 15, 1978, Pat. No. 4,241,557.

[51] Int. Cl.[3] ..... E04C 3/18

[52] U.S. Cl. ..... 52/693; 52/696; 52/DIG.6; 411/466

[58] Field of Search ..... 52/693, 694, 695; 411/466

[56] References Cited

U.S. PATENT DOCUMENTS

| | | | |
|---|---|---|---|
| 1,649,226 | 11/1927 | Gstalder | 52/DIG. 6 |
| 1,688,016 | 10/1928 | Klaasen | 52/731 |
| 3,298,151 | 1/1967 | Jureit | 52/696 |
| 3,503,173 | 3/1970 | Jureit | 52/693 |

FOREIGN PATENT DOCUMENTS

| | | | |
|---|---|---|---|
| 841501 | 6/1952 | Fed. Rep. of Germany | 52/696 |
| 580727 | 10/1972 | Switzerland | 52/DIG. 6 |
| 1011093 | 11/1965 | United Kingdom | 52/696 |

*Primary Examiner*—John E. Murtagh

*Attorney, Agent, or Firm*—Thorpe, North & Western

[57] ABSTRACT

A construction member includes an upper and lower chord joined together by a plurality of spacer plates positioned along the length of the chords. Struts are disposed to extend diagonally between the upper and lower chords and between each pair of adjacent spacer plates. The spacer plates include teeth for embedding into the chords and the struts to form a rigid and sturdy construction member.

9 Claims, 5 Drawing Figures

CONSTRUCTION MEMBER AND CONNECTING PLATE STRUCTURE

BACKGROUND OF THE INVENTION

This is a continuation-in-part application of copending application, Ser. No. 906,067, filed May 15, 1978 now U.S. Pat. No. 4,241,557.

This invention relates to studs, trusses, and similar construction members, and more particularly to a construction member comprising upper and lower chords joined together by a spacer plate; the invention also relates to the spacer plate structure itself.

Building material costs have increased dramatically in recent years leading to an interest in finding construction material substitutes which require, for example, less wood. Most building materials presently used consists of heavy, solid lumber elements such as the common "2×4", "2×6", etc. since wood is in relatively short supply, it would be desirable to reduce the amount of wood required for building materials without sacrificing strength, durability and ease of use.

There have been a number of proposals for providing studs or trusses made partly of wood and some type of connector elements. See, for example, U.S. Pat. Nos. 3,298,151, 3,849,963 4,078,352 and 1,688,016. The construction members disclosed in these patents, however, either lack simplicity or sturdiness as a result of combining the use of wood with metal or other joining or connecting elements.

SUMMARY OF THE INVENTION

It is an object of the invention to provide a simple and easy to fabricate construction member.

It is another object of the invention to provide a construction member suitable for use as floor joists and the like which is relatively strong and yet lightweight.

It is still another object of the invention to provide such a construction member which may be fabricated without the use of nails, staples or similar fastening elements.

It is a further object of the invention to provide a new and improved spacer plate for joining upper and lower chords into a rigid and sturdy construction member.

It is an additional object of the invention to provide such a spacer plate which may readily accommodate fabrication of such a construction member.

It is also an object of the invention to provide a construction member composed of an upper and lower chord, spacer plates for joining the upper and lower chord, and struts diagonally interconnecting the upper and lower chords and adjacent plates.

The above and other objects are realized in a specific illustrative embodiment of a construction member comprising an upper chord, a lower chord, a spacer plate or plurality of plates for joining the upper and lower chords together, and one or more struts positioned to extend diagonally between the upper and lower chords from one spacer plate to an adjacent plate. The spacer plate is positioned in a direction generally perpendicular to the axes of the chords and includes upper and lower slots in its upper and lower edges respectively for receiving the upper and lower chords. The spacer plate also includes a stem portion between the slots, and flanges at each side of the slots and stem portions folded flush against the sides of the chords in a direction parallel to the axes of the chords. This configuration provides a rigid, sturdy and yet lightweight building construction member.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
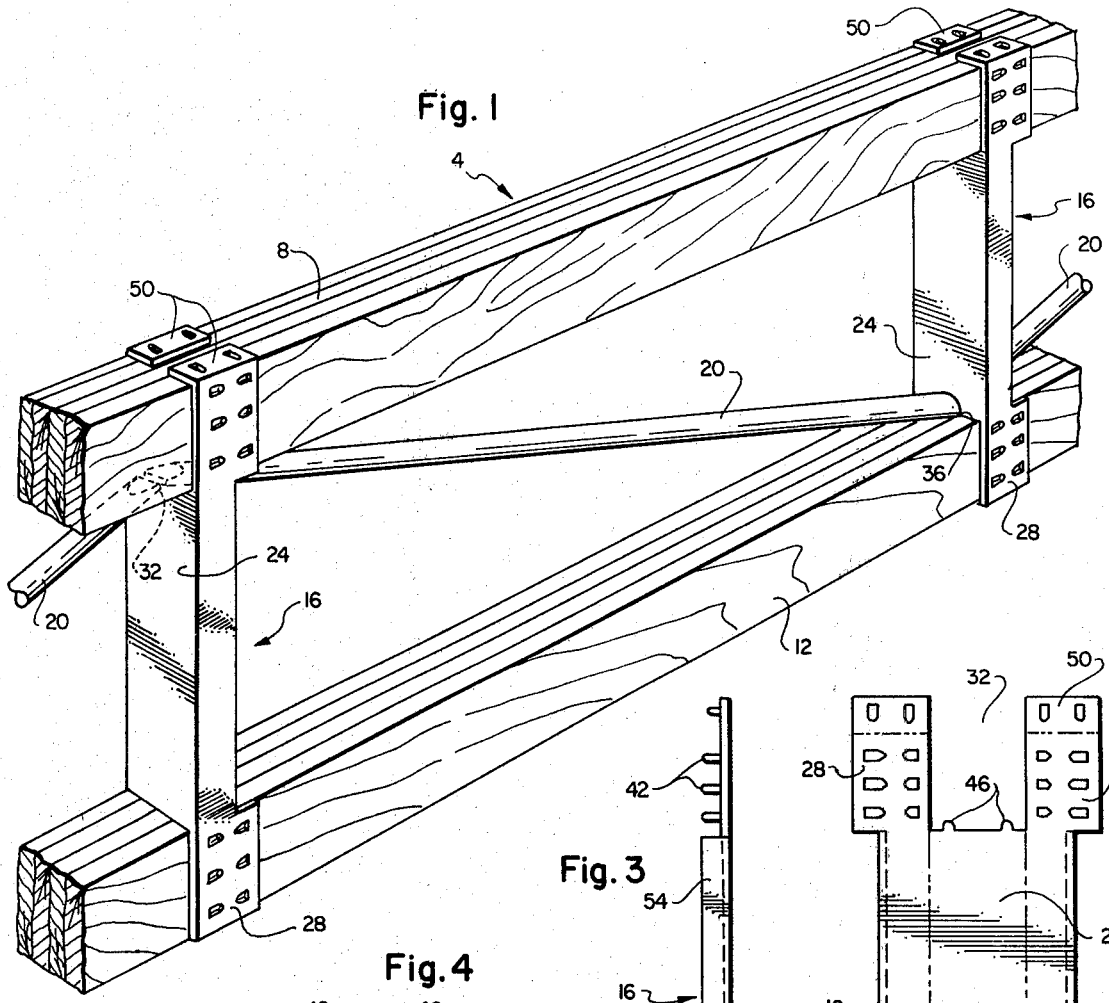
FIG. 1 is a perspective view of a construction member made in accordance with the principles of the present invention.

Referring to FIG. 1, there is shown a construction member 4 having an upper chord 8, a lower chord 12, spacer plates 16, and struts 20. The chords 8 and 12 advantageously are composed of wood illustrated as being plywood in FIG. 1. However, other materials such as chipboard, fiberboard, extruded plastics such as polyethylene and polyurethane, extruded expanded rubber, and similar materials could also be used for the chords 8 and 12.

Figure 3:
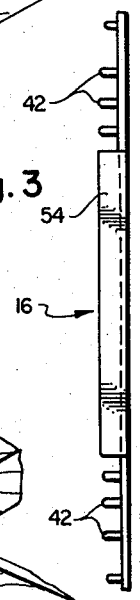
FIG. 3 is a side elevational view of the spacer plate shown in FIG. 1.
Figure 2:
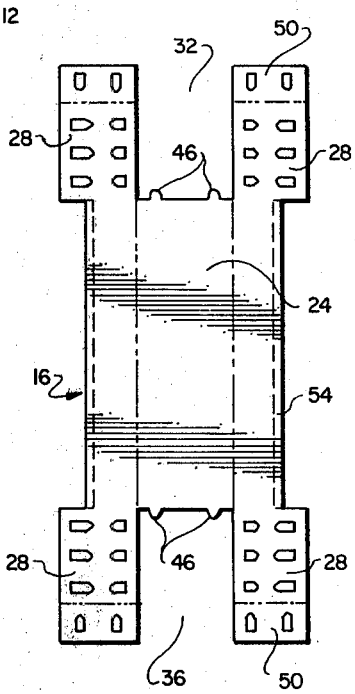
FIG. 2 is a front elevational view of the spacer plate used in the construction member of FIG. 1.
Figure 4:
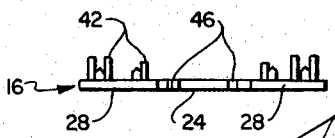
FIG. 4 is a top view of the spacer plate shown in FIG. 1.

The chords 8 and 12 are maintained in a spaced-apart, generally parallel relationship by the spacer plates 16. These plates are shown in detail in FIGS. 2 through 4 to include a flat piece of material such as sheet metal containing a stem portion 24 and a pair of flanges 28 disposed laterally on each side of the stem portion. Each flange extends beyond the upper and lower edge of the stem portion 24 to define slots 32 and 36 for receiving the upper chord 8 and lower chord 12 respectively as shown in FIG. 1.

The flanges 28 are folded to form right angles with the stem portion 24 and to lie generally flush against the sides of the chords. The stem portion 24 is oriented to be generally perpendicular to the long axes of the chords. Teeth 42 project perpendicularly from the flanges to embed in the chords 8 and 12 as shown in FIG. 1. Teeth 46 are also provided on the upper and lower edges of the stem portion 24 and are embedded in the bottom surface of the upper chord 4 and the top surface of the lower chord 12 when the chords are placed in the slots 32 and 36.

The flanges 28 include extended portions 50 which project beyond the top and bottom surfaces of the upper chord 8 and lower chord 12 respectively and are folded flush to such surfaces as shown in FIG. 1. The extended portions 50 of the flanges 28 provide additional rigidity to the entire structure to maintain the chords 8 and 12 in place in the slots 32 and 36 of the spacer plates 16.

The flanges 28 of each spacer plate 16 also include a lip portion 54 intermediate of the upper and lower edge of the flange and folded inwardly to extend between the bottom surface of the upper chord 8 and the upper surface of the lower chord 12. These lip portions 54 provide additional support to the stem portion 24 for joining the upper and lower chords 8 and 12.

Preferably the spacer plates 16 are composed of sheet metal such as 18–28 gauge galvanized iron. However, plastic, fiberglass, or similar materials could also be used. Although the spacer plates 16 show the teeth 42 punched out of and extending from the flanges into the upper and lower chords, it should be recognized that nails, staples, or similar fastening elements could also be used instead of the punched out teeth.

Struts 20 extend diagonally between the upper chord 8 and lower chord 12 from one spacer plate to a next adjacent plate as shown in FIG. 1. The struts 20 are shown placed in a zig-zag relationship to extend alternately between the upper chord 8 and a plate and the lower chord 12 and the next adjacent plate, and the lower chord 12 and a plate and the upper chord 8 and the next following plate, etc. Alternatively, the struts 20 could be disposed to be generally parallel with one another. The ends of the struts 20 are shown abutting the stem portions 24 of the spacer plate 16 and abutting the bottom surface of the upper chord 8 and the upper surface of the bottom chord 12. The struts are maintained in place by suitable adhesive or other fastening element.

Figure 5:
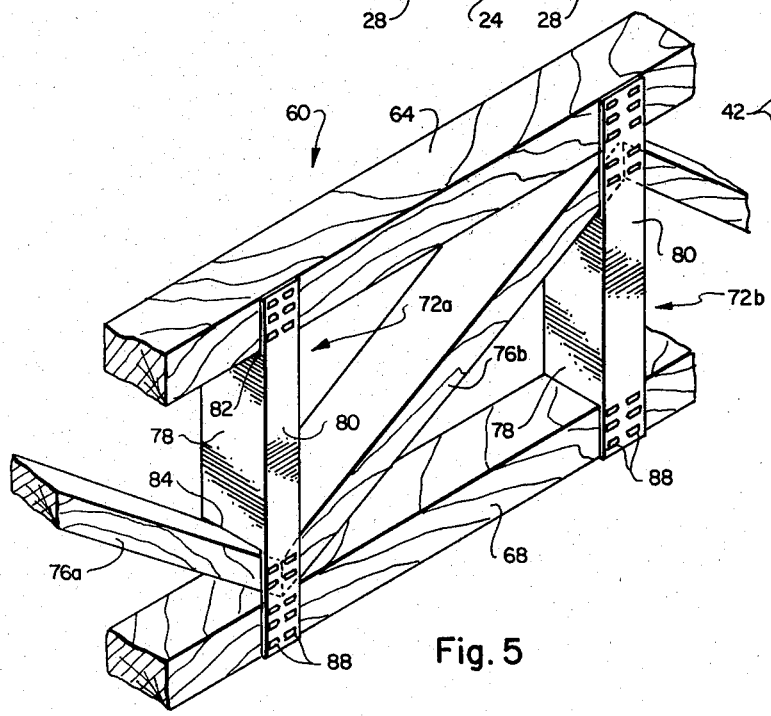
FIG. 5 is a perspective view of another embodiment of a construction member made in accordance with the present invention.

FIG. 5 shows an alternative embodiment of a construction member 60 comprised of an upper chord 64 and a lower chord 68 joined together by spacer plates 72 and struts 76. The chords 64 and 68 and strut 76 are shown as solid pieces of lumber but, of course, they could be comprised of other materials such as plywood, chipboard, etc. The ends of adjacent strut 76 abutt one another within the spacer plate 72 as shown by the dotted lines in FIG. 5.

The spacer plate 72 includes a stem portion 78 and flanges 80 located on either side of the stem portion. The flanges 80 extend beyond the upper edge 82 of the stem portion 78 and beyond the lower edge 84 to define slots into which the chords 64 and 68 are received. One of the slots in each spacer plate is deeper than the other to also accommodate the struts. Thus, spacer plate **72*a* includes a deeper slot at its lower end to allow receipt of one end of strut 76*a* as shown in FIG. 5. The end of strut 76*a* abuts and mates with one end of the next adjacent strut 76*b* which extends diagonally between the spacer plate 72*a* and the lower chord 68 to the next adjacent plate 72*b* and the upper chord 64. The spacer plate 72*b* includes a deeper slot at its upper end to receive one end of the strut 76*b* as also shown in FIG. 5**.

The spacer plates 72 of FIG. 5 also include teeth 88 which extend from the flanges thereof to embed not only in the upper chord 64 and lower chord 68 but also in the ends of abutting struts. Spacer plate **72*a* includes a set of teeth at the upper end of the flanges 80 to embed in the upper chord 64, another set of teeth at the lower end of the flanges to embed in the lower chord 68 and then a third set of teeth, positioned just above the lowest set, to embed in the abutting ends of the struts 76*a* and 76*b* as shown. This provides additional rigidity and strength to the construction members 60 and serves to hold not only the chord 64 and 68 in place but also the struts 76**.

Note that the flanges 80 of the spacer plates 72 are folded in the same direction. This facilitates fabrication since rollers or other pressure applying device can press the flanges of successively encountered spacer plates in the same direction to embed the teeth 88 into the chords.

It is to be understood that the above-identified arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A construction member comprising:

an upper chord;

a lower chord;

a spacer plate or plurality of plates rigidly joining the upper and lower chords, each spacer plate positioned in a direction generally perpendicular to the axes of the chords and having upper and lower slots in its upper and lower edges respectively for receiving the upper and lower chords, a stem portion between the slots, and flanges at each side of the slots and stem portion and folded flush against the sides of the chords in a direction parallel to the axes of the chord; and one or more struts positioned to extend between the upper and lower chords from one spacer plate to an adjacent plate;

wherein said spacer plates include teeth projecting from said flanges into the chords and struts.

2. A construction member comprising:

an upper chord;

a lower chord;

a spacer plate or plurality of plates rigidly joining the upper and lower chords, each spacer plate positioned in a direction generally perpendicular to the axes of the chords and having upper and lower slots in its upper and lower edges respectively for receiving the upper and lower chords, a stem portion between the slots, and flanges at each side of the slots and stem portion and folded flush against the sides of the chords in a direction parallel to the axes of the chords; and one or more rigid struts positioned to extend between the upper and lower chords from one spacer plate to an adjacent plate.

3. A construction member as in claim 1 wherein said struts are positioned generally along the length of the chords.

4. A construction member as in claim 1 wherein said struts are disposed in a zig-zag fashion to extend alternately between the upper chord and a plate and the lower chord and next adjacent plate, and the lower chord and a plate and the upper chord and next adjacent plate.

5. A construction member as in claim 1 wherein said struts are disposed to be generally parallel to one another.

6. A construction member as in claim 1 wherein the stem portions of the spacer plates each includes an opening at the top or bottom thereof for receiving the end of a strut.

7. A construction member as in claim 6 wherein the ends of adjacent struts are positioned contiguously between the flanges of a spacer plate.

8. A construction member as in claim 1 wherein said flanges include extensions which project beyond the top and bottom surfaces of the upper and lower chords respectively and are folded flush to such surface.

9. A construction member as in claim 8 wherein said extensions include teeth which are embedded in the top and bottom surfaces of the upper and lower chords.

* * * * *